United States Patent [19]

Lai et al.

[11] 4,169,773

[45] Oct. 2, 1979

[54] REMOVAL OF CHLORATE FROM ELECTROLYTIC CELL ANOLYTE

[75] Inventors: Peter Lai, Grand Island; Stanley Szymanski, Youngstown; Norman L. Christensen, Cheektowaga, all of N.Y.

[73] Assignee: Hooker Chemicals & Plastics Corp., Niagara Falls, N.Y.

[21] Appl. No.: 870,054

[22] Filed: Jan. 16, 1978

[51] Int. Cl.[2] ..... C25B 1/16; C25B 1/26; C25B 1/02

[52] U.S. Cl. ..... 204/98; 204/128; 204/129

[58] Field of Search ..... 204/98, 128, 129, 130

[56] References Cited

U.S. PATENT DOCUMENTS

| | | | |
|---|---|---|---|
| 665,953 | 1/1901 | Chalandre et al. | 204/98 |
| 2,569,329 | 9/1951 | Osborne et al. | 204/98 |
| 2,967,807 | 1/1961 | Osborne et al. | 204/98 |

OTHER PUBLICATIONS

General Chemistry by H. Sisler et al, 1949, pp. 423–424.

*Primary Examiner*—R. L. Andrews
*Attorney, Agent, or Firm*—Peter F. Casella; Howard M. Ellis

[57] ABSTRACT

In the production of chlorine and caustic by the electrolytic decomposition of brine in a membrane cell, depleted anolyte is often recirculated, with salt resaturation. Chlorate build-up in this recirculating brine results from membrane inefficiencies, and has in the past required purging. It has now been found that a portion of the recirculating brine stream may be reacted with strong acid, such as HCl, to reduce the chlorate, resulting in production of additional chlorine, water, and salt. Such chlorine may be joined with the cell product, while the salt may be utilized in the resaturation of the remainder of the recirculating brine stream.

12 Claims, 1 Drawing Figure

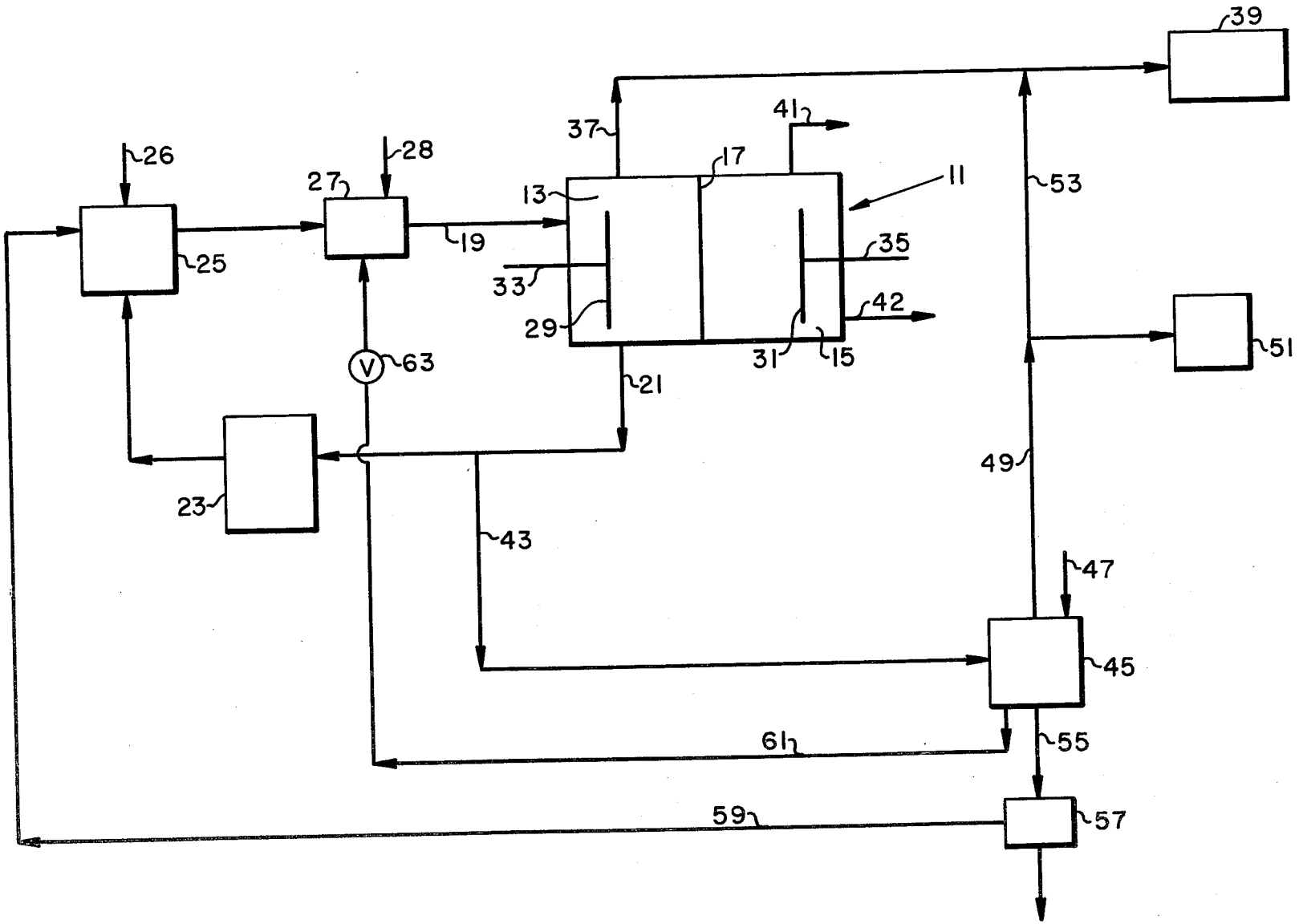
39
51
53
49
47
45
55
57
11
35
42
15
41
31
17
37
13
33
29
21
43
61
59
19
28
63
27
25
26
23

REMOVAL OF CHLORATE FROM ELECTROLYTIC CELL ANOLYTE

BACKGROUND OF INVENTION

The present invention relates to the electrolytic production of high purity alkali metal hydroxide solutions. The alkali metal hydroxides of the present invention are produced along with halides utilizing membrane electrolytic cells by the passage of an electric current through an alkali metal halide solution.

Electrolytic cells that are commonly employed commercially for the conversion of alkali metal halides into alkali metal hydroxides and halides may be considered to fall into the following general types: (1) diaphragm, (2) mercury, and (3) membrane cells.

Diaphragm cells utilize one or more diaphragms permeable to the flow of electrolyte solution but impervious to the flow of gas bubbles. The diaphragm separates the cell into two or more compartments. Upon imposition of a decomposing current, halide gas is given off at the anode, and hydrogen gas and alkali metal hydroxide are formed at the cathode. Although the diaphragm cell achieves relatively high production per unit floor space, at low energy requirements and at generally high current efficiency, the alkali metal hydroxide product, or cell liquor, from the catholyte compartment is both dilute and impure. The product may typically contain about 12 percent by weight of alkali metal hydroxide along with about 12 percent by weight of the original, unreacted, alkali metal chloride. In order to obtain a commercial or salable product, the cell liquor must be concentrated and purified. Generally, this is accomplished by evaporation. Typically, the product from the evaporators is about 50 percent by weight alkali metal hydroxide containing about 1 percent by weight alkali metal chloride.

Mercury cells typically utilize a moving or flowing bed of mercury as the cathode and produce an alkali metal amalgam on the mercury cathode. Halide gas is produced at the anode. The amalgam is withdrawn from the cell and treated with water to produce a high purity alkali metal hydroxide. Although mercury cell installations have a high initial capital investment, undesirable ratio of floor space per unit of product, relatively poor power efficiencies, and negative ecological considerations, the purity of the alkali metal hydroxide product is an inducement to its use. Typically, the alkali metal hydroxide product contains less than 0.05 percent by weight of contaminating foreign anions.

Membrane cells utilize one or more membranes or barriers separating the catholyte and the anolyte compartments. The membranes are permselective, that is, they are selectively permeable to either anions or cations. Generally, the permselective membranes utilized are cationically permselective. In membrane cells employing a single membrane, the membrane may be porous or non-porous. In membrane cells employing two or more membranes, porous membranes are generally utilized closest to the anode, and non-porous membranes are generally utilized closest to the cathode. The catholyte product of the membrane cell is a relatively high purity alkali metal hydroxide. Examples of membrane cells are described in U.S. Pat. Nos. 3,017,338; 3,135,673; 3,222,267; 3,496,077; 3,654,104; 3,899,403; 3,954,579; and 3,959,085. The catholyte product, or cell liquor, from a membrane cell is purer and of a higher concentration than the product of a diaphragm cell.

It has been the objective, but not the result, for diaphragm and membrane cells to commercially produce "rayon grade" alkali metal hydroxide, that is, a product having a contamination of less than about 0.5 percent of the original salt. Diaphragm cells have not been able to produce such a product directly, because anions of the original salt freely migrate into the catholyte compartment of the cell. Membrane cells have the capability to produce a high purity alkali metal hydroxide product. A problem encountered in membrane cells is the production of chlorate in the anolyte compartment, which will readily not pass through a cation permselective membrane. Accordingly, chlorates concentrate in the anolyte, and after a brief period of operation may reach objectionable concentration levels. While chlorates are not known to rapidly deteriorate membrane or anode structures, high concentrations thereof reduce the concentration of electrolyte (salt) present, resulting in decreased efficiencies, possible chloride precipitation, and potentially adverse chlorate concentrations in caustic product.

In the past, removal of chlorate from diaphragm cell liquor has been handled in a number of ways. For example, Johnson, in U.S. Pat. No. 2,790,707, teaches removal of chlorates and chloride from diaphragm cell liquor by formation of complex iron salts by adding ferrous sulfate. Osborne, in U.S. Pat. No. 2,823,177, teaches prevention of chlorate formation during electrolysis of alkali metal chloride in diaphragm cells by destruction of hypochlorite through distribution of catalytic amounts of nickel or cobalt in the diaphragm. It is noteworthy that considerable effort has been expended in chlorate removal from cell liquor, a highly alkaline medium. In the presence of an excess of alkali, the chlorate is quite stable. It therefore tends to persist in the cell effluent and to pass on through to the evaporators in which the caustic alkali is concentrated. Practically all of the chlorate survives the evaporation and remains in the final product, where it constitutes a highly objectionable contaminant, especially to the Rayon industry.

The problem of lowering chlorates in diaphragm cells has been attacked at two main points:

(a) The chlorates having been formed, can be reduced in the further processing of the caustic alkali and by special treating methods. See for instance, U.S. Pat. Nos. 2,622,009; 2,044,888; 2,142,670; 2,207,595; 2,258,545; 2,403,789; 2,415,93, 2,446,868; and 2,562,169 which show representative examples of different methods used for reducing the chlorates after they have been formed;

(b) The production of chlorates during the electrolysis can be lowered by adding a reagent to the brine feed which reacts preferentially with the back migrating hydroxyl ions from the cathode compartment of the cell making their way through the diaphragm into the anode compartment, and by such a reaction prevents the formation of some of the hypochlorites and thus additionally preventing these hypochlorites from further reacting to form chlorates. Reagents such as hydrochloric acid, shown in U.S. Pat. No. 585,330, and sulfur in an oxidizable form, such as sodium tetrasulfide, shown in U.S. Pat. No. 2,569,329 are illustrative of methods which have been used to attack the problem of chlorates in caustic by removing the back migrating hydroxyl ions before they can react to form chlorates.

In membrane cell operation, it is conventional to recycle spent brine from the anolyte compartment for resaturation. In the past, removal of chlorate from such recirculating brine has been accomplished by purging a portion of the stream and adding fresh brine as makeup. The purged chlorate-containing brine may, for example, be fed to a chlorate cell for use therein.

SUMMARY OF INVENTION

The present invention relates to a method for direct treatment of the recirculating brine stream to effectively reduce chlorate content therein prior to resaturation. Although the process of the present invention may be utilized in the electrolysis of any alkali metal halide sodium chloride is preferred and is normally the alkali metal halide used. However, other alkali metal chlorides may be utilized, such as potassium chloride or lithium chloride.

The present invention consists of treating a portion of the recirculating brine stream of a membrane cell so as to remove chlorate values therefrom. Chlorate buildup occurs in membrane cell recycle brine systems due to membrane inefficiencies. Where co-production of chlorate is not carried on, a method of chlorate level control is necessary. The membrane cell will usually be operated in such a manner that only a portion of the brine stream will have to be treated for chlorate removal. That is, the chlorate concentration build-up in the brine with each pass through the membrane cell may be lower than the chlorate concentration in the brine that the total system can tolerate, thereby requiring treatment of only a portion of the total brine stream. Further, while it is possible to treat the entire recirculation stream, it has been found advantageous to treat only a portion thereof to minimize capital and operating expenses.

The diverted stream is passed to a reaction vessel, wherein the depleted anolyte, containing about 100–300 gpl NaCl, from about 1 to about 100 gpl $NaClO_3$, and dissolved $Cl_2$ and NaOCl, at a pH of from about 1–6, is treated with concentrated HCl. Any minor impurities present in the brine will remain in the recirculating anolyte unless specifically removed, but for purposes of clarity, will not be discussed herein. The addition of HCl causes reduction of the chlorate in accordance with either Reaction (1) or Reaction (2):

$$NaClO_3 + 2HCl \rightarrow ClO_2 + \tfrac{1}{2}Cl_2 + H_2O + NaCl \quad (1)$$

$$NaClO_3 + 6HCl \rightarrow NaCl + 3Cl_2 + 3H_2O \quad (2)$$

The two reactions are competing in the reaction mixture, and Reaction (2) is desired to minimize chlorine dioxide production. Accordingly, it is preferred to operate at or near the stoichiometry of Reaction (2). However, some $ClO_2$ will normally be created during the reaction. Since chlorine dioxide gas in concentrated amounts is spontaneously explosive, the chlorine dioxide produced must be controllably reduced to $Cl_2 + O_2$. It has been found possible to accomplish this by subjecting the gaseous products of the reaction to irradiation with ultraviolet light. It has been found advantageous to irradiate the reaction mixture itself, to insure complete decomposition of $ClO_2$ as it is formed. Irradiation with light of suitable wave lengths may be accomplished in a variety of ways. The most practical source of ultraviolet light is a mercury arc. Sunlight is also effective in catalyzing the reaction, but is of too low an intensity for practical use. Because of the intensity of their radiation, medium and high pressure mercury arcs are the preferred sources of ultraviolet radiation for this process. It is not intended, however, to limit the process to their use. The use of either sunlight or low pressure mercury arcs fall within the scope of this invention. Whatever the source, the intensity of radiation provided is from about 0.01 to about 10 watts or higher. The chlorine and oxygen products of the decomposition of chlorine dioxide may be passed to a scrubber, and absorbed in aqueous alkali, or may be joined safely, due to the absence of chlorine dioxide, to the cell system's chlorine handling system, such as liquifaction, or sodium hypochlorite production. While $ClO_2$ decomposition is preferably accomplished by ultraviolet radiation, it will be recognized that this may be accomplished by other means, such as by heating, passage through a spark gap, or catalytic decomposition.

The sodium chloride salt formed may be precipitated for either recovery or for recycle and use in the resaturator for the brine system. If excess HCl is utilized, the reaction liquor, consisting of NaCl, HCl, and $H_2O$, may be utilized to adjust the pH of the resaturated brine.

DETAILED DESCRIPTION OF INVENTION

The present invention will be described in more detail by a discussion of the accompanying drawing.

Membrane cell 11 is illustrated with two compartments, compartment 13 being the anolyte compartment, and compartment 15 being the catholyte compartment. It will be understood that although, as illustrated in the drawing, and in a preferred embodiment, the membrane cell is a two compartment cell, a buffer compartment or a plurality of buffer compartments may be included. Anolyte compartment 13 is separated from catholyte compartment 15 by cationic permselective membrane 17. A feed of sodium chloride solution is fed into anolyte compartment 13 of cell 11 by line 19. Depleted sodium chloride brine is removed by anolyte recirculation line 21, and submitted to dechlorination in vessel 23, resaturation in vessel 25, and pH adjustment at 27, by addition of HCl 28. Cell 11 is equipped with anode 29 and cathode 31, suitably connected to a source of direct current through lines 33 and 35, respectively. Upon passage of a decomposing current through cell 11, chlorine is generated at the anode and removed from the cell in gaseous form through line 37, to chlorine recovery means 39. Hydrogen is generated at the cathode, and is removed through line 41. Sodium hydroxide is formed at the cathode, and removed through line 42. The sodium hydroxide product taken from line 42 is substantially sodium chloride free, containing less than 1 percent by weight of sodium chloride, and, preferably, has a concentration of from about 9% to about 40% by weight sodium hydroxide. Suitably, the sodium chloride feed material, entering cell 11 from resaturator 25 and pH adjustment 27 by line 19, contains from about 130 to about 330 grams per liter sodium chloride, and, most preferably, from about 250 to about 320 grams per liter. The solution may be neutral or basic, but is preferably acidified to a pH in the range of from 1 to 6, preferably achieved with a suitable acid such as hydrochloric acid.

The depleted brine stream, removed from the cell for recirculation and resaturation by line 21, is split for chlorate removal by the process of the present invention. Line 43 may remove from about 0.5 percent to 50 percent of the content of line 21, but preferably from 1 to 10 percent. This side stream 43 is directed to reaction vessel 45, wherein chlorate content of the depleted brine stream is reduced in accordance with Reactions (1) and (2) above. Reaction vessel 45 has inlet 47 for addition of acid, and outlet 49 for removal of gaseous decomposition product. Gases produced may be vented to a chlorine disposal system 51 for absorption in sodium hydroxide solution, or alternatively, through lines 53 and 37 may be passed to the chlorine handling system 39. Salt produced by the reduction of chlorate, in accordance with Reaction (1) or (2), is removed from reaction vessel 45 through line 55, and may be crystallized at 57, and preferably, returned by line 59 to resaturator 25 for resaturation of the recirculating brine. Additional make-up salt may be added to the recirculating brine in the resaturator by line 26, as required. Alternatively, residual acid, containing dissolved sodium chloride, may be passed from reaction vessel 45 by line 61 and valve 63 to pH control 27 when the operating conditions of vessel 45 yield an unsaturated salt solution. It will be recognized that possible additional elements, such as heat exchangers, steam lines, salt filters and washers, mixers, pumps, compressors, holding tanks, etc, have been left out of the figure for ease of understanding, but that the use of such auxiliary equipment and/or systems is conventional. Further, certain systems, such as the dechlorinator and the chlorine handling system, are not described in detail, since such systems are well known to one of skill in the art.

Membrane cells, or electrolytic cells utilizing permselective membranes to separate the anode and the cathode during electrolysis, are known in the art. For example, such cells are described in U.S. Pat. Nos. 3,899,403; 3,954,579; and 3,959,095. Within recent years, improved membranes have been introduced. The improved membranes are preferably utilized in the present invention. Such membranes are fabricated of a hydrolyzed copolymer of a perfluorinated hydrocarbon and a sulfonated perfluorovinyl ether. More specifically, suitable membrane materials are fabricated of a hydrolyzed copolymer of tetrafluoroethylene and a fluorosulfonated perfluorovinyl ether of the general formula: $FSO_2CF_2CF_2OCF(CF_3)CF_2OCF{=}CF_2$. Generally, such polymers have an equivalent weight of from about 900 to about 1,600. Such membrane materials are available commercially, from E. I. DuPont de Nemours and Co., under the trademark Nafion®. In use, the membranes are usually supported on networks of supporting materials such as polytetrafluoroethylene, perfluorinated ethylene propylene polymer, polypropylene, asbestos, titanium, tantalum, niobium or noble metals. Utilizing an alkali metal halide feed, a membrane cell produces alkali metal hydroxide and hydrogen at the cathode and halide at the anode.

A membrane cell has an anolyte and a catholyte compartment separated by one or more membranes, preferably of the type described above. Such membranes may be classified as "cation-active permselective," that is, membranes that permit the passage therethrough of cations. Normally, the membrane wall thickness will range from about 0.02 to about 0.5 mm., preferably, from about 0.1 to about 0.5 mm., and, most preferably, from about 0.1 to about 0.3 mm. When mounted on a polytetrafluoroethylene, asbestos, titanium or other suitable network for support, the network filaments or fibers will usually have a thickness of from about 0.01 to about 0.5 mm, and, preferably, from about 0.05 to about 0.15 mm., corresponding to the thickness of the membrane.

A particularly useful arrangement of membranes in a three compartment cell utilizing a buffer compartment and used to electrolyze an alkali metal halide solution is to position a permeable membrane between the anolyte and the buffer compartments and a hydraulically impermeable cation-permeable membrane between the catholyte and the buffer compartments. This arrangement permits the flow of liquid to and from the anolyte compartment while inhibiting the flow of halogens outward from the anolyte compartment. However, because the porous membrane is not a perfect and absolute barrier to halogens, and hypohalites, some of these materials migrate into the buffer compartment to the detriment of the hydrocarbon ion exchange membrane separating the catholyte compartment. The barrier between the catholyte compartment and the adjacent buffer compartment is hydraulically impermeable to solutions, but is selectively permeable to cations, thus allowing alkali metal ions from the buffer compartment to pass therethrough and react with the hydroxyl ions formed in the catholyte compartment. Various arrangements of membranes and various types of membrane materials have been proposed. The present invention is useful in membrane cells and is not limited to any specific compartment arrangement or type of membrane, except that the present invention is particularly adapted to membrane cells having only one membrane, placed directly between the anolyte and catholyte compartments. However, halate build-up will occur in multiple compartment cells as well, on the anode side of an impermeable cation permselective membrane.

While various anodes and cathodes may be utilized it is preferred to employ dimensionally stable anodes, most preferably ruthenium oxide or other suitable noble metal or noble metal oxide on titanium or other suitable valve metal, e.g., tantalum, and to utilize steel for the cathode. Preferably, both electrodes will be in mesh form, but they also may be continuous, perforated, or if other types.

Typically, a membrane cell utilizes a brine feed entering the anolyte compartment and operates at current densities between about 0.5 to about 4.0 amperes per square inch, and, preferably, between about 1.0 to about 3.0 amperes per square inch. Current efficiencies from about 70 to about 95% are normally obtained. Voltage drops across the cell are usually in the range of from about 2.3 to about 5.0 volts and, preferably, are maintained in the range of from about 2.3 to about 4.5 volts.

It is to be noted that other than HCl, such strong acids as sulfuric acid and phosphoric acid may be utilized for the reduction of chlorates. However, when such are used in place of hydrochloric acid, the resultant sulfate and/or phosphate salts must be suitably disposed of. While sulfate addition to the recirculating brine is not desirable, the use of phosphate in the brine has in the past been proposed for control of brine hardness.

A further disclosure of the nature of the invention is provided by the following specific examples. It should be understood that the data disclosed serve only as examples and are not intended to limit the scope of the invention.

EXAMPLE 1

A synthetic cell liquor was made, containing 200 gpl NaCl and 40 gpl $NaClO_3$. Exactly 100 ml of this liquor was charged to a 250 ml three neck flask equipped with a thermometer, gas inlet, addition funnel, condenser, and gas outlet. The liquor was heated and maintained at 65° C., with one batch run at 90° C., before the required amount of concentrated HCl (405 gpl) was charged to the flask. The gas produced was diluted with air, and prescrubbed with water before absorption in aqueous KI. Analysis of the KI solution at the conclusion of the experiment yielded an average gram atom % $ClO_2$, from which efficiency was determined relative to reactions $R_1$ and $R_2$. The reaction liquor was periodically analyzed for chlorate concentration to establish the chlorate depletion rate, and at the conclusion of the experiment the reaction liquor was analyzed for acid and chloride content. Complete data for the experimental runs is illustrated in Table I. Reaction efficiency is based upon the equations:

$$R_1: HClO_3 + HCl \rightarrow ClO_2 + 0.5Cl_2 + H_2O,$$

$$R_2: HClO_3 + 5HCl \rightarrow 3Cl_2 + 3H_2O,$$

and is expressed in terms of the percentage occurring according to $R_1$. In performing the reaction, the object was to minimize reaction $R_1$, which produces chlorine dioxide, and achieve reaction conditions promoting reaction $R_2$.

TABLE I

| SAMPLE | INITIAL CONCENTRATION M/L NaClO3 | NaCl | HCl | REACTION CONDITIONS T °C. | Minutes | REACTION MIXTURE M/L NaClO3 | NaCl | HCl | GRAM ATOM % ClO2 | REACTION EFFICIENCY % R1 | % NaClO3 REACTED |
|---|---|---|---|---|---|---|---|---|---|---|---|
| 1 | 0.35 | 3.17 | 0.90 | 65–66 | 30 | 0.28 | | | | | |
| | | | | | 60 | 0.26 | | | | | |
| | | | | | 120 | 0.23 | 3.28 | 0.19 | 12.1 | 47 | 34.3 |
| 2 | 0.34 | 3.05 | 1.34 | 65–66 | 10 | 0.25 | | | | | |
| | | | | | 30 | 0.20 | | | | | |
| | | | | | 90 | 0.17 | 2.84 | 0.48 | 11.3 | 45 | 50.0 |
| 3 | 0.33 | 2.95 | 1.69 | 63–68 | 15 | 0.17 | | | | | |
| | | | | | 36 | 0.13 | | | | | |
| | | | | | 118 | 0.08 | 3.47 | 0.49 | 11.2 | 45 | 75.8 |
| 4 | 0.30 | 2.75 | 2.40 | 65–66 | 15 | 0.05 | | | | | |
| | | | | | 30 | 0.02 | | | | | |
| | | | | | 60 | 0.01 | 3.26 | 0.88 | 10.2 | 42 | 96.7 |
| 5 | 0.29 | 2.59 | 2.97 | 64–66 | 5 | 0.02 | | | | | |
| | | | | | 10 | 0.005 | | | | | |
| | | | | | 15 | 0.004 | | | | | |
| | | | | | 20 | 0.0009 | 4.02 | 1.62 | 7.4 | 36 | 99.7 |
| 6 | 0.29 | 2.59 | 2.97 | 88–99 | 12 | 0.0004 | 3.28 | 1.44 | 6.8 | 34 | 99.9 |

The effect of acid concentration on chlorate reactivity in the batch reaction, varying the initial HCl concentration from 0.9 to 3.0 molar is illustrated. With 3.0 molar HCl the chlorate was completely reacted in approximately 20 minutes at 65° C., while at 0.9 molar only a 34% reduction in $NaClO_3$ concentration resulted after a 120 minute reaction period.

EXAMPLE 2

Experiments were performed according to the procedure set forth in Example 1, with the following changes. Synthetic cell liquor containing 263 gpl NaCl and 43 gpl $NaClO_3$ was used, and the reaction was operated near the boiling point of the system (approximately 103° C.). Reactions were performed using 12, 16, and 24 ml of concentrated HCl per 100 ml of cell liquor. Results are set forth in Table II, clearly illustrating the effect of increased HCl addition.

TABLE II

| SAMPLE | ML HCl ADDED | REACTION CONDITIONS T °C. | Minutes | REACTION MIXTURE gpl NaClO3 | HCl | NaCl | GRAM ATOM % ClO2 | REACTION EFFICIENCY % R1 | % NaClO3 REACTED |
|---|---|---|---|---|---|---|---|---|---|
| 7 | 12 | 95–102 | 0 | 38.2 | 44.0 | 235 | | | |
| | | | 11 | 16.4 | — | — | | | |
| | | | 30 | 14.7 | — | — | | | |
| | | | 60 | 14.7 | 0.9 | 275 | 5.8 | 30 | 62 |
| 8 | 16 | 100–103 | 0 | 36.0 | 56 | 227 | | | |
| | | | 10 | 9.5 | — | — | | | |
| | | | 30 | 6.7 | — | — | | | |
| | | | 38 | 6.5 | 2.9 | 270 | 4.3 | 25 | 82 |
| 9 | 24 | 97–103 | 0 | 34.5 | 79 | 212 | | | |
| | | | 10 | 0 | — | — | | | |
| | | | 30 | 0 | 20.4 | 251 | 4.4 | 25 | 100 |

This experiment emphasized decreasing the chemical cost of the invention. The amount of water was minimized by operating with more concentrated cell liquor, and the reaction was performed at a higher temperature.

EXAMPLE 3

A Hooker MX® membrane cell is utilized for the manufacture of chlorine and caustic, as illustrated in the FIGURE. After equilibrium is reached, the following product streams and approximate material balances result, in pounds per hour per ton of $Cl_2$ produced. The anolyte recirculation stream 21 consists of about 15,732 pounds NaCl, 1096 pounds $NaClO_3$, 115 pounds NaOCl, and 49,806 pounds $H_2O$. A treatment stream 43, comprising 1.8% of the volume of the brine recirculation stream, and containing about 280 pounds NaCl, 19 pounds $NaClO_3$, 2 pounds NaOCl, and 886 pounds $H_2O$, is fed to reaction vessel 47, where it is reacted with about 21 pounds HCl, and 48 pounds $H_2O$. The reaction vessel yields 818 pounds $H_2O$, 22 pounds $Cl_2$, 2 pounds $O_2$. In addition, 293 pounds NaCl and 15 pounds water are taken from the crystallizer 57 to the resaturator, 25, where they are joined with 2985 pounds of crystalline salt to resaturate the brine. In the pH adjustment, 6 pounds HCl and 13 pounds $H_2O$ are added to the brine prior to reentry into cell 11. Also exiting the cell, from the anolyte compartment, are 16 pounds of $O_2$, 454 pounds of $H_2O$, and 1898 pounds of $Cl_2$, which when joined by 102 pounds of $Cl_2$ recovered by the dechlorination unit 23, yields one ton of chlorine per hour. The dechlorination unit is fed 131 pounds HCl and 306 pounds $H_2O$ per hour, yielding 37 pounds $H_2O$ in addition to the aforesaid $Cl_2$. From the catholyte compartment of cell 11, 60 pounds $H_2$, 2162 pounds NaOH, and 9002 pounds $H_2O$ are withdrawn.

The chlorate reduction reaction takes place under ultraviolet radiation, insuring that no $ClO_2$ is produced in reaction vessel 45. Operating at a temperature of from about 70° C. to about 90° C., essentially complete removal of chlorate from the treated stream is achieved. From the above, it is seen that a substantial reduction of chlorate content in the recirculating brine stream is possible, with the resulting products being either used directly in the chlor-alkali system itself, or being joined with the cell products to increase yield.

The invention has been described with respect to specific illustrative embodiments, but it is evident that one of ordinary skill in the art will be able to utilize substitutes and equivalents without departing from the spirit of the invention or the scope of the claims.

What is claimed is:

1. In a process for producing alkali metal hydroxide and a halide by the electrolysis of an aqueous metal halide electrolyte in a membrane cell, wherein halates are produced as a by-product, and anolyte is recirculated and resaturated prior to return to the anolyte compartment of said cell, the improvement which comprises:

(a) diverting a portion of the anolyte recirculation stream to a reaction zone outside the membrane cell, said anolyte recirculation stream comprising alkali metal halide and alkali metal halate;

(b) contacting said portion in said reaction zone with a stoichiometric or excess amount of an acid to reduce essentially all of said alkali metal halate to halogen, alkali metal halide, halogen dioxide and water;

(c) decomposing the halogen dioxide formed in (b) to halogen and oxygen;

(d) recovering said halogen and crystalline alkali metal halide from said reaction zone and the halogen formed in (b); and (e) utilizing at least a portion of said crystalline alkali metal halide to resaturate the alkali metal halide electrolyte.

2. A process as set forth in claim 1, wherein the aqueous alkali metal halide electrolyte is sodium chloride brine, the halate is sodium chlorate, and said acid is hydrochloric acid.

3. The process as set forth in claim 2, wherein said chlorine dioxide is decomposed in the presence of ultraviolet radiation.

4. The process of claim 2, wherein said halogen is chlorine, which is fed to the chlorine recovery system of said membrane cell.

5. In a process for producing alkali metal hydroxide and a halide by the electrolysis of an aqueous metal halide electrolyte in a membrane cell, wherein halates are produced as a by-product, and anolyte is recirculated and resaturated prior to return to the anolyte compartment of said cell, the improvement which comprises:

(a) diverting a portion of the anolyte recirculation stream to a reaction zone outside the membrane cell, said anolyte recirculation stream comprising alkali metal halide and alkali metal halate;

(b) contacting said portion with a stoichiometric or excess amount of an acid selected from the group consisting of hydrochloric acid, sulfuric acid, phosphoric acid and mixtures thereof;

(c) decomposing any halogen dioxide formed in (b), and (d) recovering the reaction products formed in (b) and (c).

6. In a process for producing alkali metal hydroxide and a halide by the electrolysis of an aqueous metal halide electrolyte in a membrane cell, wherein halates are produced as a by-product, and anolyte is recirculated and resaturated prior to return to the anolyte compartment of said cell, the improvement which comprises:

(a) diverting a portion of the anolyte recirculation stream to a reaction zone outside the membrane cell said anolyte recirculation stream comprising alkali metal halide and alkali metal halate;

(b) contacting said portion in said reaction zone with a stoichiometric or excess amount of an acid to reduce essentially all of said alkali metal halate to halogen, alkali metal halide, halogen dioxide and water;

(c) decomposing halogen dioxide formed in (b) to halogen and oxygen;

(d) recovering halogen and an unsaturated mixture of acid, alkali metal halide and water; and (e) utilizing said mixture to adjust the pH of the anolyte recirculation stream.

7. A process as set forth in claim 6, wherein the aqueous alkali metal halide electrolyte is sodium chloride brine, the halate is sodium chlorate, and said acid is hyrochloric acid.

8. A process as set forth in claim 7, wherein said chlorine dioxide is decomposed in the presence of ultraviolet radiation.

9. A process for the electrolytic production of sodium hydroxide and chlorine, which process comprises electrolytically decomposing a sodium chloride brine in an electrolytic cell comprising an anode, a cathode, an anode chamber, a cathode chamber and a permselective cationic membrane separating said anode chamber and said cathode chamber; recirculating spent brine from said anode chamber, resaturating said brine and feeding the resaturated spent brine to said membrane cell anode chamber; diverting from 0.5 to 50% of said spent brine prior to resaturation to a reaction zone outside the electrolytic cell, and treating said diverted spent brine with an excess amount of hydrochloric acid to decompose sodium chlorate present therein; decomposing the chlorine dioxide that is formed by the reaction of said sodium chlorate and said hydrochloric acid to form chlorine and oxygen; recovering said chlorine; recovering crystalline sodium chloride from the reaction of said sodium chlorate and hydrochloric acid and utilizing said crystalline sodium chloride to resaturate the spend anolyte.

10. A process as set forth in claim 9, wherein said chlorine dioxide is reduced to chlorine and oxygen by radiation with ultraviolet light.

11. A process as set forth in claim 9, wherein said portion diverted from said recirculating brine comprises from 1 to 10% of said anolyte.

12. A process for the electrolytic production of sodium hydroxide and chlorine, which process comprises electrolytically decomposing a sodium chloride brine in an electrolytic cell comprising an anode, a cathode, an anode compartment, a cathode compartment and a permselective cationic membrane separating said anode compartment and said cathode compartment; recirculating spent brine from said anolyte compartment, resaturating said spent brine and feeding resaturated spent brine to said membrane cell anode compartment; diverting from 0.5 to 50% of said spent brine prior to resaturation to a reaction zone outside the electrolytic cell, and treating said diverted spent brine with an excess amount of hydrochloric acid to decompose sodium chlorate present therein; decomposing the chlorine dioxide that is formed by the reaction of said sodium chlorate and said hydrochloric acid to form chlorine and oxygen; recovering said chlorine; recovering excess hydorchloric acid, sodium chloride and water; and recirculating said excess hydrochloric acid, sodium chloride and water to the anode compartment of said cell.

* * * * *